US006187428B1

(12) United States Patent
Chambon

(10) Patent No.: US 6,187,428 B1
(45) Date of Patent: Feb. 13, 2001

(54) WHEEL RUT-RESISTANT CARRIAGEWAY AND PROCESS FOR OBTAINING SUCH A CARRIAGEWAY

(75) Inventor: Alain Chambon, Vourles (FR)

(73) Assignee: Colas S.A., Boulogne Billancourt Cedex (FR)

( * ) Notice: Under 35 U.S.C. 154(b), the term of this patent shall be extended for 0 days.

(21) Appl. No.: 09/221,572

(22) Filed: Dec. 29, 1998

(30) Foreign Application Priority Data

Dec. 30, 1997 (FR) ..... 97 16713

(51) Int. Cl.[7] ..... B32B 3/26

(52) U.S. Cl. ..... 428/307.7; 428/304.4; 428/308.4; 428/317.1; 428/317.9

(58) Field of Search ..... 428/304.4, 307.7, 428/308.4, 317.1, 317.9

(56) References Cited

U.S. PATENT DOCUMENTS

| | | | | |
|---|---|---|---|---|
| 2,083,900 | * | 6/1937 | Ebberts | 94/23 |
| 3,603,221 | | 9/1971 | Barton | 94/9 |
| 3,690,227 | | 9/1972 | Welty | 94/33 |
| 3,819,291 | | 6/1974 | McConnaughay | 404/75 |
| 3,847,630 | | 11/1974 | Compernass et al. | 106/97 |
| 3,870,422 | | 3/1975 | Medico, Jr. | 404/17 |
| 3,965,281 | | 6/1976 | Takase et al. | 404/75 |
| 4,167,356 | | 9/1979 | Constantinescu | 404/31 |
| 4,371,401 | | 2/1983 | Langumier . | |
| 4,398,842 | | 8/1983 | Hodson | 404/75 |
| 4,515,839 | | 5/1985 | Broaddus et al. | 106/98 |
| 5,254,385 | | 10/1993 | Hazlett | 428/76 |
| 5,405,440 | | 4/1995 | Green et al. | 404/17 |
| 5,759,250 | | 6/1998 | Malot et al. . | |

FOREIGN PATENT DOCUMENTS

| | | | |
|---|---|---|---|
| 1290862 | | 3/1969 | (DE) . |
| 2146903 | * | 3/1973 | (DE) . |
| 2321783 | | 11/1974 | (DE) . |
| 0041881 | | 12/1981 | (EP) . |
| 0381903 | | 8/1990 | (EP) . |
| 0433155 | | 6/1991 | (EP) . |
| 0760386 | | 3/1997 | (EP) . |
| 2647478 | | 11/1990 | (FR) . |
| 2647822 | | 12/1990 | (FR) . |
| 2674548 | | 10/1992 | (FR) . |
| 2742174 | | 6/1997 | (FR) . |

* cited by examiner

*Primary Examiner*—Helen L. Pezzuto
(74) *Attorney, Agent, or Firm*—Greenblum & Bernstein, P.L.C.

(57) ABSTRACT

A wheel rut-resistant carriageway and process for obtaining a wheel rut-resistant carriageway. The wheel rut-resistant carriageway includes at least one rigid base layer, at least one intermediate layer, and a rough upper layer. The at least one rigid base layer has a thickness in the range of approximately 6 cm to approximately 8 cm. The at least one intermediate layer is disposed over the at least one rigid base layer and has a thickness in the range of approximately 4 cm to approximately 5 cm. The at least one intermediate layer has a high void rate allowing for the evacuation of heat by ventilation. The rough upper layer is disposed over the intermediate layer and has a thickness in the range of approximately 2 cm to approximately 3 cm. The process includes applying the at least one rigid base layer having a thickness in the range of approximately 6 cm to approximately 8 cm to a surface. Applying the at least one intermediate layer over the at least one rigid base layer, the at least one intermediate layer having a thickness in the range of approximately 4 cm to approximately 5 cm. The at least one intermediate layer having a high void rate allowing for the evacuation of heat by ventilation. Applying the rough upper layer over the intermediate layer, the rough upper layer having a thickness in the range of approximately 2 cm to approximately 3 cm.

27 Claims, 1 Drawing Sheet

WHEEL RUT-RESISTANT CARRIAGEWAY AND PROCESS FOR OBTAINING SUCH A CARRIAGEWAY

BACKGROUND OF THE INVENTION

1. Field of the Invention

The invention relates to a wheel rut-resistant carriageway as well as to a process for obtaining such a carriageway.

2. Description of Background and Relevant Information

A carriageway comprises generally a foundation layer, a base layer, a binding layer and an upper layer. All these layers consist of materials treated with either hydraulic or tar binders. The materials and the binders are determined in relation to the type of traffic that the carriageway has to sustain or, in other words, in relation to the type of wear and deformation to which the carriageway will be subjected when in use. One of these phenomena to which the carriageway is thus exposed, is the formation of wheel ruts.

The ruts, generally defined as deep tracks or marks left by the wheels of a vehicle on a path, result from the load of the vehicles circulating over the carriageway and from the temperature rise of the said carriageway.

Indeed, the formation of wheel ruts in a carriageway comprising bituminous concrete layers is boosted when the temperature of the carriageway or of one of the layers, exceeds the softening temperature of the bitumen of the layer. The carriageway temperature results mainly from the ground temperature on which the carriageway lies and from its exposure to the sun. Moreover, a carriageway designed to sustain the traffic of heavy vehicles undergoes greater stresses in areas such as an approach to a highway toll where the carriageway must sustain the braking of the vehicles or the storage of the trucks in the waiting queues than in the driving zones of the highway lanes.

To remedy this particular fragility of the carriageways, it may be contemplated to build the highly stressed zones of the latter essentially as concrete slabs. However, this solution is solely retained for the new construction of zones of this nature since, in such a case, the time required by concrete to set is acceptable. On the other hand, when repairing the carriageway, this time for the concrete to set is too long and implies traffic prohibitions for trucks for an unacceptable duration.

Wheel ruts in carriageways are dangerous since they channel rainwater and make the carriageway slippery; the more so for trucks when they have to brake when approaching zones such as toll stations. Various technologies have been used to avoid the formation of wheel ruts. Thus, a method consists in mixing the bituminous binder with a mixed load of mineral granulates and waste flakes of plastic material (FR-2.742.174). Another technique consists in using a road coating compound comprising a tar concrete and acrylonitrile fibres, preferably kidney-shaped ones (FR-2.647.822).

Besides, tests have been conducted with 'white' coated materials to benefit from the fact that this color absorbs heat less than the usual black tone of bitumen. However, the resistance of such coated materials to the formation of wheel ruts is very poor.

The various techniques described hereabove can be summarized as some kind of replacement technique: part of the agregate is replaced by voids, these voids being obtained by an appropriate choice of the particulate grade of the agregate.

Whatever the resistance to the formation of wheel ruts in the bituminous layers prepared according to these various techniques, none of the latter gives complete satisfaction.

SUMMARY OF THE INVENTION

The purpose of the invention is to provide a wheel rut-resistant carriageway which is constituted in order to improve its resistance to the formation of wheel ruts.

It must be possible to build such a carriageway from scratch as well as to repair an existing one.

The purpose of the invention is met by a wheel rut-resistant carriageway comprising at least one base layer and one upper layer as well as at least one high void rate intermediate layer allowing for evacuation of part of the heat that is introduced into the intermediate layer, by ventilation, thanks to the high void rate.

We call "void rate" the ratio of the volume of voids in respect to the volume of the intermediate layer. This void rate is also called void percentage when expressed in percent.

To interpose an insulation layer between the base layer and the upper layer first enables to associate bituminous products whose formulation is suited, for each layer forming the carriage, to the specific loads encountered during the use of the carriageway and which exhibit good wheel rut resistance. At the same time, it enables, while insulating the lower layers of the carriageway from the upper layers, to avoid any significant rise in their temperatures. This is obtained both by a reduction of the amount of heat transmitted and by ventilation of the intermediate layer resulting in a partial evacuation of heat thanks to the high void rate.

Indeed, the upper layer is generally applied, directly or via a bonding layer; onto a base layer consisting of dense coated materials. This layer made of dense coated materials does not transmit the heat from the upper layer to the lower layer entirely, but causes the temperature to drop by approx. 1° C. per centimeter of thickness of the layer. Contrary to that, the intermediate layer according to the invention enables to reduce this temperature by approx. 2° C. by centimeter of thickness.

According to the embodiment selected, the carriageway of the invention exhibits either of the following technical characteristics, considered individually or with all their technically possible combinations:

The intermediate layer comprises draining coated materials.

The void rate of the intermediate layer ranges from about 25 to about 30%; advantageously, it amounts to approx. 30%.

The base layer consists of hard bitumen, possibly with a polyethylene additive, which creates a rigid support in order to distribute adequately the loads applied by heavy vehicles. The hard bitumens used to this effect exhibit a ball ring temperature (standardised temperature at which bitumen softens) above 50° C. The thickness of the base layer ranges, advantageously, from 6 to 8 cm. The coated materials treated with this hard bitumen, with or without polyethylene additive, must exhibit a complex module, measured according to the French standard NF P 98-260-2, greater than 14,000 MPa. Advantageously, this complex module exhibits a value ranging between 14,000 MPa and 18,000 MPa.

Let us mention that the French standard NF P 98-260-2 relates to the determination of the complex module by sine wave flexion of a tar mixture and that the complex module is the ratio between a stress and a relative complex deformation of a tar mixture whose behaviour is considered as linear viscoelastic. Determination of the complex module is performed at four temperatures, at least, spaced by no more than 10° C. and for each temperature, at three frequencies at least, regularly spaced, of a sine wave load.

The intermediate layer consists of bituminous coated materials obtained from stone chips whose size grading and shape enable to provide for a void rate of approx. 30%. These coated materials contain a very small quantity of sand, advantageously lower than 10%. The thickness of the intermediate layer is advantageously approx. 4–5 cm.

For comparison purposes, it has been stated that the void rate of a layer consisting of draining coated materials is approx. 20%.

The upper layer is rough in order to improve the braking effect of the trucks. Its thickness is advantageously approx. 2–3 cm.

The carriageway comprises a bonding layer applied on the intermediate layer. Advantageously, this bonding layer consists of cold-cast coated materials. This bonding layer improves adhesion between the various coated materials and ensures, together with the upper layer, the tightness of the intermediate layer.

The insulating effect of the intermediate layer is obtained by a high void rate of the bituminous concrete used for the construction of this layer. The void rate or the void percentage of the bituminous concrete depends at the same time on the discontinuity of the size grading of the stone chipping selected and on their shape, as it will be described in detail further.

According to readings, the carriageway temperature rarely exceeds, and only marginally, 60° C. Taking into account the insulating capacity of the intermediate layer, the base layer provides, according to its thickness, a thermal protection of approx. 10° C. As the hard bitumens used for the formulation of the base layer have a softening temperature above 50° C., the base layer, which is the most sensitive to the formation of wheel ruts, is protected by the intermediate layer.

Moreover, the upper layer is only 2–3 cm thick. Thus, with a wheel rut formation of approx. 10%, the wheel ruts liable to appear during the usage of the carriage should not exceed 2–3 mm in height. Let us remember that the height of a wheel rut is defined as the level difference between the apexes of two bumps and the level of the hollow caused by the passage of the vehicles' wheels. The currently tolerated height of the wheel ruts is 5 mm.

The invention consists therefore not only in using products which, technically, cannot, or hardly, give rise to the formation of wheel ruts, but also to assemble them in such a way that they protect one another. Thus, the protection is amplified by evacuation of heat thanks to the high void rate. The selection of bituminous materials, usable not only for the construction of new carriageways, but also for their repair, enables the carriageways to be brought back into operation shortly after repairs.

The purpose of the invention is also met with a process enabling to build a wheel rut-resistant carriageway. This process comprises the application of a base layer and the application of an upper layer, as well as the application of an intermediate layer, made of a material with a high void rate.

According to an advantageous embodiment of this process, the construction of the carriageway according to the invention comprises, in the order stated, the following steps:

application of a foundation layer, application of a base layer, application of an intermediate layer constituting a binding layer made of a high void rate material and, application of an upper layer.

As a variation to this embodiment, the construction process comprises moreover the application of a bonding layer on the intermediate layer before the application of the upper layer.

Other characteristics and advantages of the invention will be illustrated by the following description of an advantageous embodiment of the carriage according to the invention.

BRIEF DESCRIPTION OF THE DRAWINGS

The description makes reference to the drawings, on which.

DETAILED DESCRIPTION OF THE INVENTION

The wheel rut-resistant carriageways and designed to sustain the traffic of heavy vehicles, such as for instance the highways, comprise a foundation layer 1 applied onto the supporting ground and a base layer 2 applied onto the foundation layer. The function of both these layers is to distribute the vertical loads exerted by the heavy vehicles and should resist the fatigue caused by the repetitious stresses resulting from the circulation of the vehicles. The carriageway also comprises an intermediate layer 3 and an upper layer 4 applied in succession, one after another, onto the base layer 2.

Figure 1:
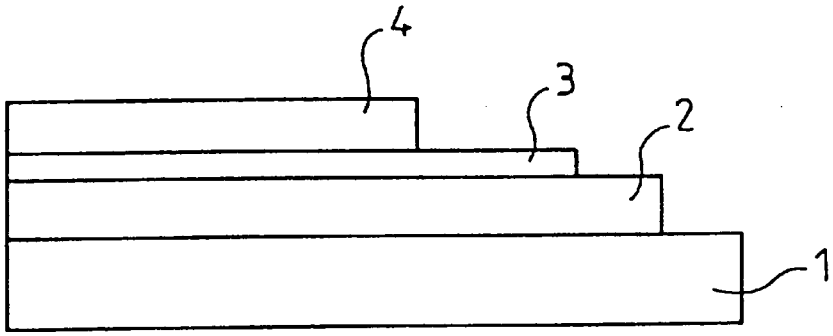
FIG. 1 represents schematically the structure of a carriageway according to the invention.
Figure 2:
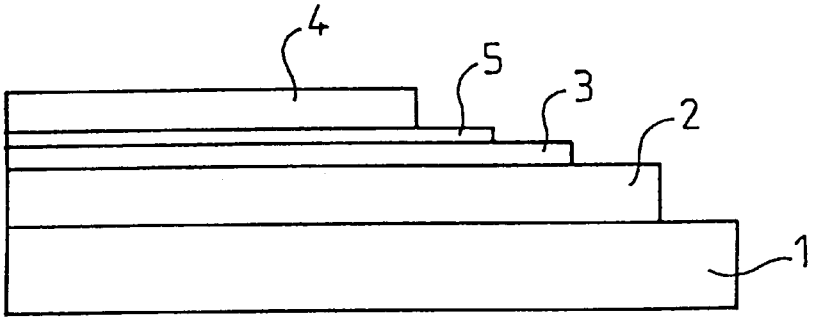
FIG. 2 represents schematically a variation of the carriageway according to FIG. 1.
Figure 3:
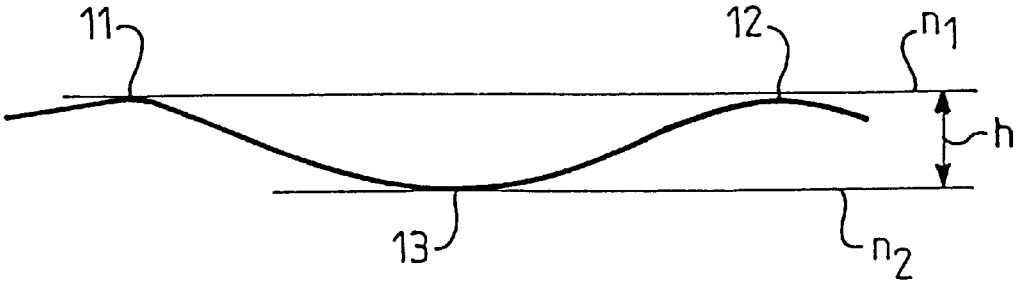
FIG. 3 illustrates the definition of the height of a wheel rut.

According to a variation of the embodiment described above, the carriageway represented on FIG. 2 comprises a bonding layer 5 applied onto the intermediate layer 3 before the application of the upper layer 4.

The base layer 2 consists of bituminous coated materials made with stone chipping whose size grading is 0/14 or 0/20 and a 10/20 type hard bitumen. The complex module of these coated materials is 14,000 MPa, measured according to the French standard NF P 98-260.2. According to the French standard NF P 98-140, these bituminous coated materials are classified as high modulus coated materials and exhibit a particular rigidity ensuring good distribution of the loads from heavy vehicles and good resistance to the formation of wheel ruts.

Let us remember that the French standard NF P 98-140 relates to tar coated materials and more particularly the lower layers made of high modulus coated materials. The rated value required according to this standard for the complex module is 14,000 MPa at 15° C. and 10 Hertz. The intermediate layer 3 consists of stone chipping with 6/10 size grading, sand and modified bitumen. The volume proportion of the sand in relation to the stone chipping is 10%. The void rate of these coated materials is assessed in laboratory using a rotating shear press according to the French standard NF P 98-252.

Let us remember that the French standard NF P 98-252 defines a test characterising the evolution of void percentage of a tar mixture subjected to an isothermal compacting process. This compacting process combines a rotating shear and a resulting axial force which is applied by a mechanical head.

The shape of the stone chipping is quite important to obtain coated materials with a defined void rate. Besides, the manufacture quality of the materials used for this type of coated materials is of paramount significance. The main characteristics of the stone chipping advantageously used to obtain an intermediate layer according to the invention are as follows:

Category B II, according to the French standard NF P 18-101

LA<25 (Los Angeles test, French standard NF P 18-573)

MDE<20 (Micro Deval in the presence of water, French standard NF P 18-572).

The upper layer 4 consists of stone chipping with 6/10 size grading, which ensures the necessary surface roughness on the braking zone of the heavy vehicles, for instance approaching a toll station.

The bonding layer 5 applied optionally consists of a cold-cast coated material.

The various layers listed above are applied with the following thicknesses:

Base layer 2: 6 to 10 cm

Intermediate layer 3: 4 to 5 cm

Upper layer 4: 2.5 cm.

The reference signs inserted after the technical characteristics mentioned in the claims solely aim at facilitating the understanding of the latter and do not limit their extent in any way.

What is claimed is:

1. A wheel rut-resistant carriageway including at least one rigid base layer, at least one intermediate layer, and a rough upper layer, the carriageway comprising:

the at least one rigid base layer having a thickness in the range of from approximately 6 cm to approximately 8 cm;

the at least one intermediate layer disposed over the at least one rigid base layer and having a thickness in the range of from approximately 4 cm to approximately 5 cm, wherein the at least one intermediate layer has a high void rate allowing for the evacuation of heat by ventilation; and the rough upper layer disposed over the at least one intermediate layer and having a thickness in the range of from approximately 2 cm to approximately 3 cm, wherein only the at least one intermediate layer comprises a void rate in the range of from approximately 25% to approximately 30%.

2. The carriageway of claim 1, wherein the at least one intermediate layer comprises bituminous coated materials.

3. The carriageway of claim 1, wherein the void rate is approximately 30%.

4. The carriageway of claim 1, further comprising a bonding layer disposed between the rough upper layer and the at least one intermediate layer.

5. The carriageway of claim 4, wherein the bonding layer is applied to the at least one intermediate layer.

6. The carriageway of claim 1, further comprising a bonding layer which is applied to the at least one intermediate layer.

7. The carriageway of claim 1, wherein the at least one intermediate layer comprises stone chipping.

8. The carriageway of claim 1, wherein the at least one rigid base layer is hard bitumen with a polyethylene additive.

9. The carriageway of claim 1, wherein the at least one rigid base layer consists of hard bitumen and a polyethylene additive.

10. The carriageway of claim 1, wherein the at least one rigid base layer exhibits a complex module value in the range of between 14,000 MPa and 18,000 MPa.

11. The carriageway of claim 1, wherein the at least one rigid base layer is treated with hard bitumen.

12. The carriageway of claim 11, wherein the at least one rigid base layer utilizes a polyethylene additive.

13. A process for obtaining a wheel rut-resistant carriageway including at least one rigid base layer, at least one intermediate layer, and a rough upper layer, the process comprising:

applying the at least one rigid base layer having a thickness in the range of from approximately 6 cm to approximately 8 cm to a surface;

applying the at least one intermediate layer over the at least one rigid base layer, the at least one intermediate layer having a thickness in the range of from approximately 4 cm to approximately 5 cm, wherein the at least one intermediate layer has a high void rate allowing for the evacuation of heat by ventilation; and applying the rough upper layer over the intermediate layer, the rough upper layer having a thickness in the range of from approximately 2 cm to approximately 3 cm, wherein only the at least one intermediate layer comprises a void rate in the range of from approximately 25% to approximately 30%.

14. The process of claim 13, wherein the surface comprises a surface of a foundation layer.

15. The process of claim 13, wherein the at least one intermediate layer comprises bituminous coated materials.

16. The process of claim 13, wherein the void rate is approximately 30%.

17. The process of claim 13, further comprising applying a bonding layer between the rough upper layer and the at least one intermediate layer.

18. The process of claim 17, wherein the bonding layer is applied to the at least one intermediate layer before the rough upper layer is applied to the bonding layer.

19. The process of claim 13, further comprising applying a bonding layer to the at least one intermediate layer.

20. The process of claim 13, wherein the at least one intermediate layer comprises stone chipping.

21. The process of claim 13, wherein the at least one rigid base layer is hard bitumen with a polyethylene additive.

22. The process of claim 13, wherein the at least one rigid base layer consists of hard bitumen and a polyethylene additive.

23. The process of claim 13, wherein the at least one rigid base layer exhibits a complex module value in the range of between 14,000 MPa and 18,000 MPa.

24. The process of claim 13, wherein the at least one rigid base layer is treated with hard bitumen.

25. The process of claim 13, wherein the at least one rigid base layer utilizes a polyethylene additive.

26. A wheel rut-resistant carriageway including at least one rigid base layer, at least one intermediate layer, and a rough upper layer, the carriageway comprising:

the at least one rigid base layer having a thickness in the range of from approximately 6 cm to approximately 8 cm;

the at least one intermediate layer disposed over the at least one rigid base layer and having a thickness in the range of from approximately 4 cm to approximately 5 cm, wherein the at least one intermediate layer has a high void rate allowing for the evacuation of heat by ventilation; and the rough upper layer disposed over the at least one intermediate layer and having a thickness in the range of from approximately 2 cm to approximately 3 cm, wherein only the high void rate of the at least one intermediate layer comprises a void rate in the range of from approximately 25% to approximately 30% such that the at least one intermediate layer insulates the rough upper layer from the rigid base layer by evacuation of heat by ventilation.

27. A process for obtaining a wheel rut-resistant carriageway including at least one rigid base layer, at least one intermediate layer, and a rough upper layer, the process comprising:

applying the at least one rigid base layer having a thickness in the range of from approximately 6 cm to approximately 8 cm to a surface;

applying the at least one intermediate layer over the at least one rigid base layer, the at least one intermediate layer having a thickness in the range of from approximately 4 cm to approximately 5 cm, wherein the at least one intermediate layer has a high void rate allowing for the evacuation of heat by ventilation; and applying the rough upper layer over the intermediate layer, tile rough upper layer having a thickness in the range of from approximately 2 cm to approximately 3 cm, wherein only the high void rate of the at least one intermediate layer comprises a void rate in the range of from approximately 25% to approximately 30% such that the at least one intermediate layer insulates the rough upper layer from the rigid base layer by evacuation of heat by ventilation.

* * * * *